US008347555B2

(12) United States Patent
Chen

(10) Patent No.: US 8,347,555 B2
(45) Date of Patent: Jan. 8, 2013

(54) SAFETY FENCE THAT IS CLOSED AUTOMATICALLY

(76) Inventor: Owen Chen, Taipei (TW)

( * ) Notice: Subject to any disclaimer, the term of this patent is extended or adjusted under 35 U.S.C. 154(b) by 109 days.

(21) Appl. No.: 12/834,928

(22) Filed: Jul. 13, 2010

(65) Prior Publication Data

US 2012/0011775 A1 Jan. 19, 2012

(51) Int. Cl.
*E05B 65/06* (2006.01)

(52) U.S. Cl. ..... 49/394; 49/50; 49/55; 49/56; 49/57; 49/463

(58) Field of Classification Search ..... 49/50, 55–57, 49/463, 394; 292/25.15, 340, 341.15, 241.117
See application file for complete search history.

(56) References Cited

U.S. PATENT DOCUMENTS 1,264,084 A * 4/1918 Jungemann ..... 292/227
1,996,196 A * 4/1935 Ferris ..... 119/523
5,396,732 A * 3/1995 Andersen ..... 49/55
6,176,042 B1 * 1/2001 Rossman et al. ..... 49/463
7,152,372 B2 * 12/2006 Cheng ..... 49/465
7,373,755 B2 * 5/2008 Jefferys et al. ..... 49/55
7,540,046 B1 * 6/2009 Lai ..... 5/100
2002/0002795 A1 * 1/2002 Rogers ..... 49/57
2005/0028947 A1 * 2/2005 Waldman et al. ..... 160/215
2006/0055182 A1 * 3/2006 Jefferys et al. ..... 292/251.5
2006/0207180 A1 * 9/2006 Cheng ..... 49/57
2007/0074453 A1 * 4/2007 Flannery ..... 49/57
2008/0296915 A1 * 12/2008 Clark et al. ..... 292/251.5
2009/0293363 A1 * 12/2009 Flannery ..... 49/55

* cited by examiner

*Primary Examiner* — Katherine W Mitchell
*Assistant Examiner* — Clarence W Mayott, III
(74) *Attorney, Agent, or Firm* — Alan Kamrath; Kamrath IP Lawfirm, PA

(57) ABSTRACT

A safety fence includes a door unit, a locking unit mounted on the door unit, a switching mechanism mounted on the door unit and connected with the locking unit, and a positioning and restoring unit mounted on the door unit. The door unit includes a first rail, a second rail and a door. Thus, when the door unit is not opened to reach the predetermined angle, the door is driven by the positioning and restoring unit and is returned and moved backward relative to the first rail to abut the second rail so that the door is locked onto the second rail by the locking unit so as to close the door unit automatically.

14 Claims, 11 Drawing Sheets

Section 6-6

SAFETY FENCE THAT IS CLOSED AUTOMATICALLY

BACKGROUND OF THE INVENTION

1. Field of the Invention

The present invention relates to a fence and, more particularly, to a safety fence that is available for a house, cot, playpen and the like.

2. Description of the Related Art

A conventional fence for a playpen comprises a first rail, a second rail spaced from the first rail and a door having a first end pivotally connected with the first rail and a second end detachably locked onto the second rail. Thus, when the door is unlocked from the second rail, the door can be pivoted relative to the first rail so as to open the fence. However, the door is not positioned exactly after it is moved relative to the first rail to a predetermined position so that the door depends in the air and is moved easily and freely, thereby causing inconvenience to the user. In addition, when the fence is opened, there is no warning device to inform the user, thereby causing danger to the baby when the fence is opened.

BRIEF SUMMARY OF THE INVENTION

In accordance with the present invention, there is provided a safety fence, comprising a door unit, a locking unit mounted on the door unit to detachably lock the door unit, a switching mechanism mounted on the door unit and connected with the locking unit to lock and unlock the locking unit, and a positioning and restoring unit mounted on the door unit to position the door unit when the door unit is movable from an original position to a predetermined position and to restore the door unit to the original position when the door unit is not disposed at the predetermined position.

The door unit includes a first rail, a second rail spaced from the first rail and a door having a first end pivotally connected with the first rail and a second end detachably locked onto the second rail by the switching mechanism and the locking unit. The locking unit is mounted between the second rail and the door. The switching mechanism is mounted between the second rail and the door. The positioning and restoring unit is mounted between the first rail and the door.

The primary objective of the present invention is to provide a safety fence that is closed automatically.

According to the primary advantage of the present invention, when the door unit is not opened to reach the predetermined angle, the door is driven by the positioning and restoring unit and is returned and moved backward relative to the first rail to abut the second rail so that the door is locked onto the second rail by the locking unit so as to close the door unit automatically.

According to another advantage of the present invention, after the door unit is opened, the warning member is activated to emit a warning signal after a preset period of time so as to inform the user that the door unit has been opened.

According to a further advantage of the present invention, when the door unit is opened to reach the predetermined angle, the door is positioned on the first rail by the positioning and restoring unit so as to position the door unit temporarily.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
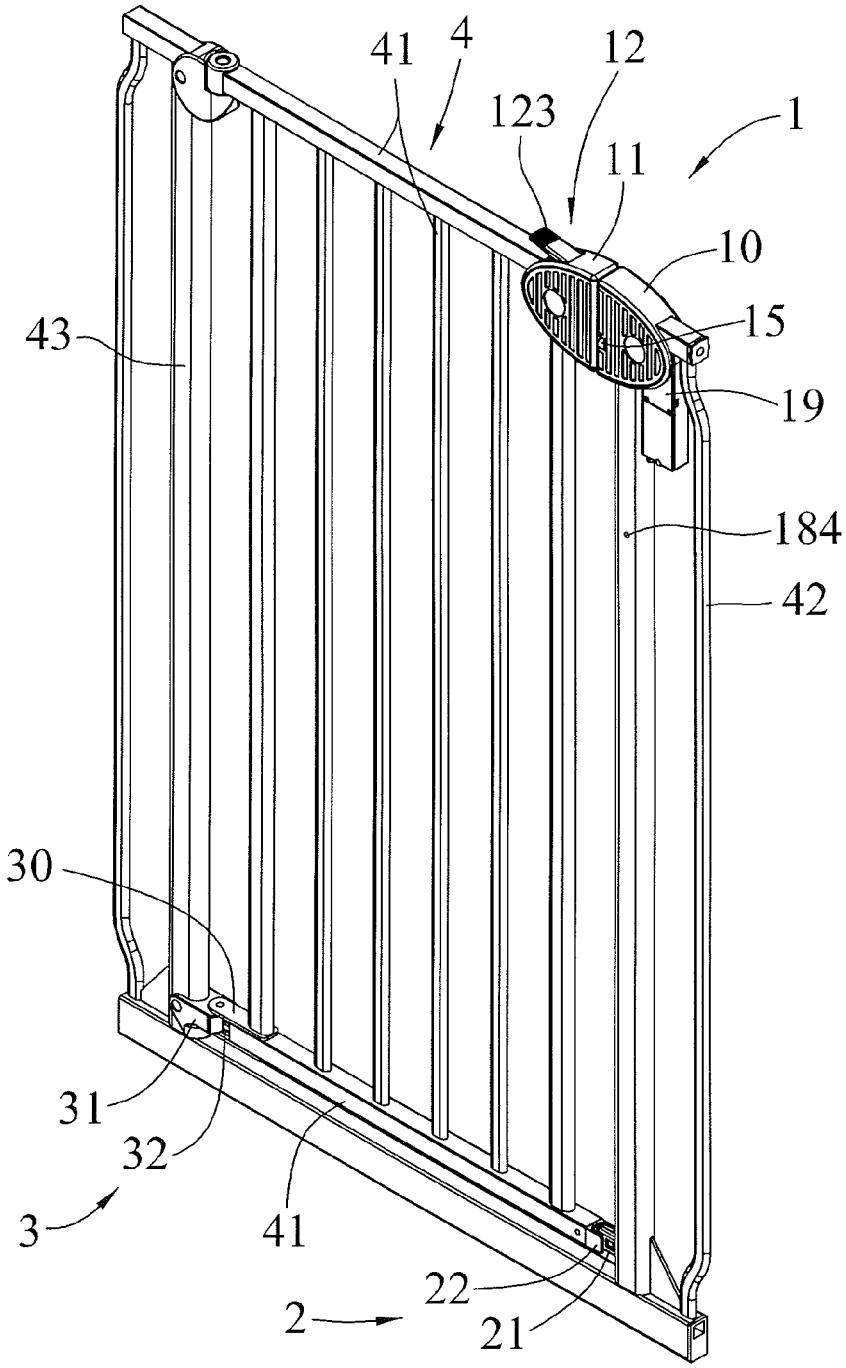
FIG. 1 is a perspective view of a safety fence in accordance with the preferred embodiment of the present invention.
Figure 2:
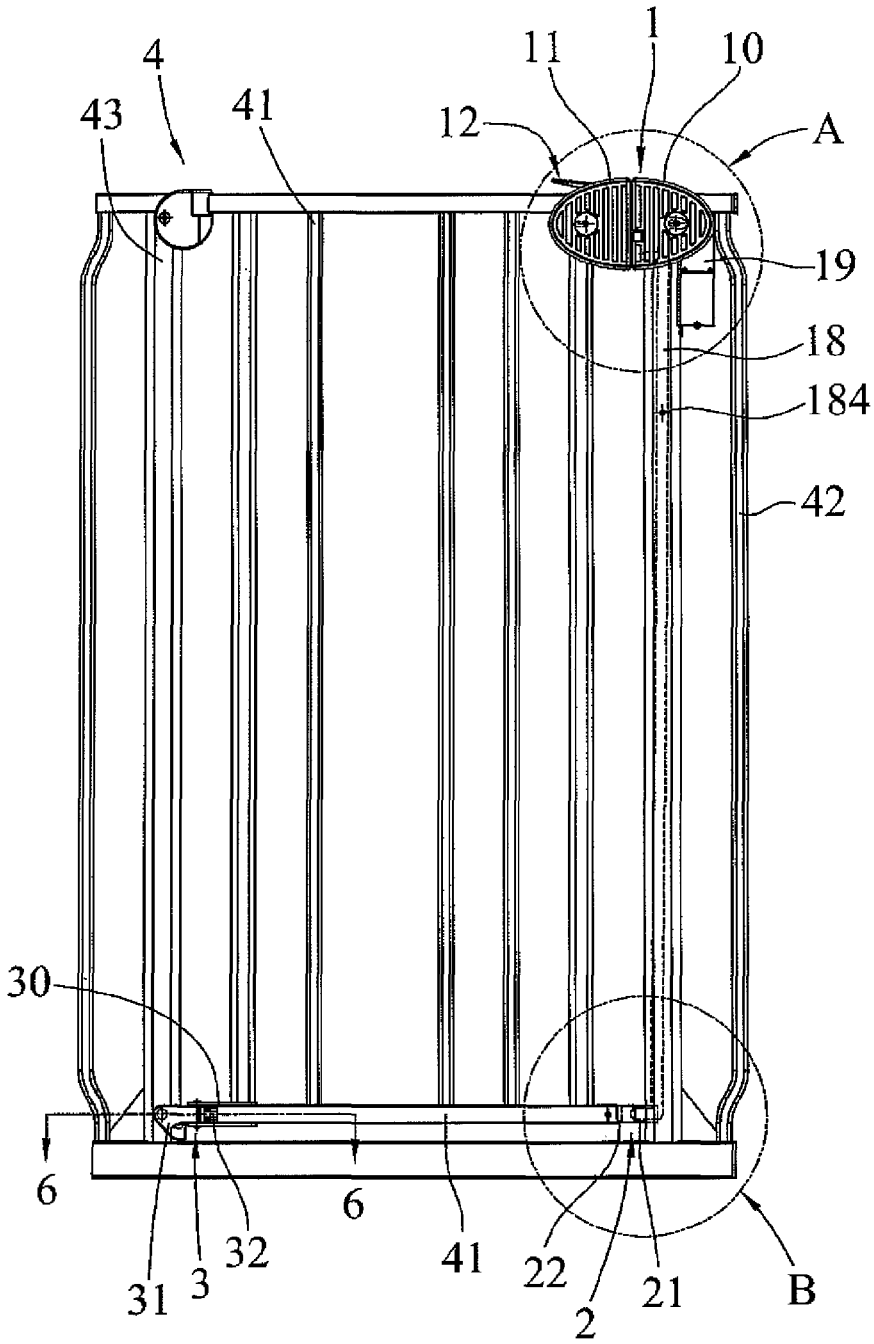
FIG. 2 is a front view of the safety fence as shown in FIG. 1.

Referring to the drawings and initially to FIGS. 1-6, a safety fence in accordance with the preferred embodiment of the present invention comprises a door unit 4, a locking unit 2 mounted on the door unit 4 to detachably lock the door unit 4, a switching mechanism 1 mounted on the door unit 4 and connected with the locking unit 2 to lock and unlock the locking unit 2, and a positioning and restoring unit 3 mounted on the door unit 4 to position the door unit 4 when the door unit 4 is movable from an original position to a predetermined position and to restore the door unit 4 to the original position when the door unit 4 is not disposed at the predetermined position.

The door unit 4 includes a first rail 43, a second rail 42 spaced from the first rail 43 and a door 41 having a first end pivotally connected with the first rail 43 and a second end detachably locked onto the second rail 42 by the switching mechanism 1 and the locking unit 2.

The locking unit 2 is mounted between the second rail 42 and the door 41 and includes a retaining member 22 mounted on a lower end of the door 41, and a locking member 21 movably mounted on a lower end of the second rail 42 and detachably locked onto the retaining member 22. The retaining member 22 has a side formed with a locking recess 221, and the locking member 21 is releasably locked in the locking recess 221 of the retaining member 22.

The switching mechanism 1 is mounted between the second rail 42 and the door 41 and includes a first housing 10 mounted on an upper end of the second rail 42, a limit track 15 mounted on the first housing 10, a second housing 11 movably mounted on an upper end of the door 41, a positioning shaft 14 mounted on the second housing 11 to move in concert with the second housing 11 and detachably limited in the limit track 15, a link 18 pivotally mounted on the second rail 42 and having an upper end provided with a driven arm 181 and a lower end provided with a drive arm 183 connected with the locking member 21 to move the locking member 21 relative to the retaining member 22, a first magnet 17 movably mounted on the first housing 10 and connected with the driven arm 181 of the link 18 to move the driven arm 181 of the link 18, a guide block 171 movably mounted on the first housing 10 and connected with the first magnet 17 to guide movement of the first magnet 17 relative to the first housing 10, and a second magnet 16 secured on the second housing 11 and repelling the first magnet 17 to move the first magnet 17.

The limit track 15 has a substantially inverted W-shaped profile and has a middle portion formed with a positioning groove 151. The positioning shaft 14 is detachably positioned in the positioning groove 151 of the limit track 15 so that the positioning shaft 14 is detachable from the positioning groove 151 of the limit track 15 when the second housing 11 is movable outward relative to the first housing 10. The positioning shaft 14 is movable upward and downward in the second housing 11, and the switching mechanism 1 further includes a push spring 141 mounted in the second housing 11 and biased between the second housing 11 and the positioning shaft 14 to push the positioning shaft 14 downward in the second housing 11. The push spring 141 is disposed above the positioning shaft 14. The second magnet 16 faces and aligns with the second housing 11 at a normal state.

The link 18 has a mediate portion pivotally connected with the second rail 42 by a pivot shaft 184. The upper end of the link 18 is further provided with an abutting arm 182. The abutting arm 182 of the link 18 is directed in a direction opposite to that of the driven arm 181 of the link 18, while the drive arm 183 of the link 18 is directed in a direction the same as that of the driven arm 181 of the link 18. The abutting arm 182 of the link 18 is disposed above the driven arm 181 of the link 18, and the pivot shaft 184 is disposed between the driven arm 181 of the link 18 and the drive arm 183 of the link 18. The guide block 171 is located between the first magnet 17 and the driven arm 181 of the link 18. The switching mechanism 1 further includes a warning member 19 mounted on the upper end of the second rail 42, a starter 191 movably mounted on the warning member 19 and abutting the abutting arm 182 of the link 18, and a restoring spring 192 mounted in the warning member 19 and biased between the warning member 19 and the starter 191 to push the starter 191 toward the abutting arm 182 of the link 18.

The switching mechanism 1 further includes a stop sleeve 13 fixed on the upper end of the door 41 and disposed in the second housing 11, a return spring 131 biased between the stop sleeve 13 and the second housing 11 to push the second housing 11 toward the first housing 10, a control handle 12 pivotally mounted on the second housing 11 and having a first end provided with a locking hook 121 detachably locked onto the stop sleeve 13 and a second end provided with a pressing portion 123, and a press spring 122 mounted on the second housing 11 and biased between the locking hook 121 of the control handle 12 and the second housing 11 to push the locking hook 121 of the control handle 12 toward the stop sleeve 13.

The locking hook 121 of the control handle 12 is movably mounted in the second housing 11, and the pressing portion 123 of the control handle 12 protrudes outward from the second housing 11. The press spring 122 is disposed above the locking hook 121 of the control handle 12. The locking hook 121 of the control handle 12 is also detachably locked the upper end of the door 41. The return spring 131 is received in the stop sleeve 13.

The positioning and restoring unit 3 is mounted between the first rail 43 and the door 41 and includes a positioning member 31 mounted on a lower end of the first rail 43, a pivot member 30 mounted on the lower end of the door 41 and pivotally connected with the positioning member 31, a positioning wheel 32 rotatably mounted on the pivot member 30 and movable to press the positioning member 31 and to position the pivot member 30 on the positioning member 31, and a restoring member 33 mounted in the lower end of the door 41 and biased between the door 41 and the positioning wheel 32 to push the positioning wheel 32 toward the positioning member 31.

The positioning member 31 has a first end secured on the lower end of the first rail 43 and a second end having a middle portion formed with a concave face 311 to receive the positioning wheel 32. The concave face 311 of the positioning member 31 has two opposite sides each formed with a convex face 312 to guide the positioning wheel 32. The second end of the positioning member 31 has two opposite corners each formed with a positioning protrusion 313 adjoining the respective convex face 312 to position the positioning wheel 32.

Again referring to FIGS. 1-6, when the second magnet 16 aligns with the first magnet 17 as shown in FIG. 3, the first magnet 17 is repelled by the second magnet 16 to push the driven arm 181 of the link 18 so as to pivot the link 18 about the pivot shaft 184 so that the abutting arm 182 of the link 18 is moved to abut the starter 191, and the drive arm 183 of the link 18 is driven to move the locking member 21 toward the retaining member 22 such that the locking member 21 is locked in the locking recess 221 of the retaining member 22 as shown in FIG. 5 to lock the door 41 onto the second rail 42 so as to close the door unit 4.

Figure 3:
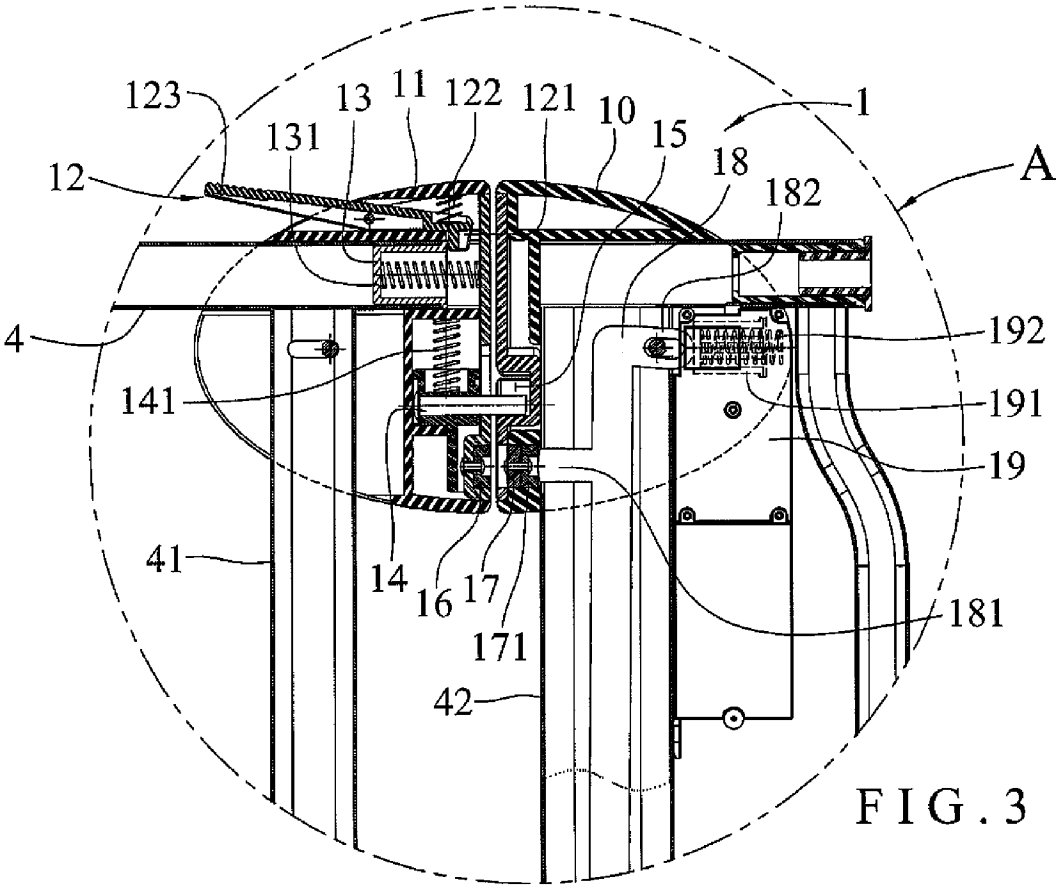
FIG. 3 is a locally enlarged cross-sectional view of the safety fence taken along circle "A" as shown in FIG. 2.
Figure 5:
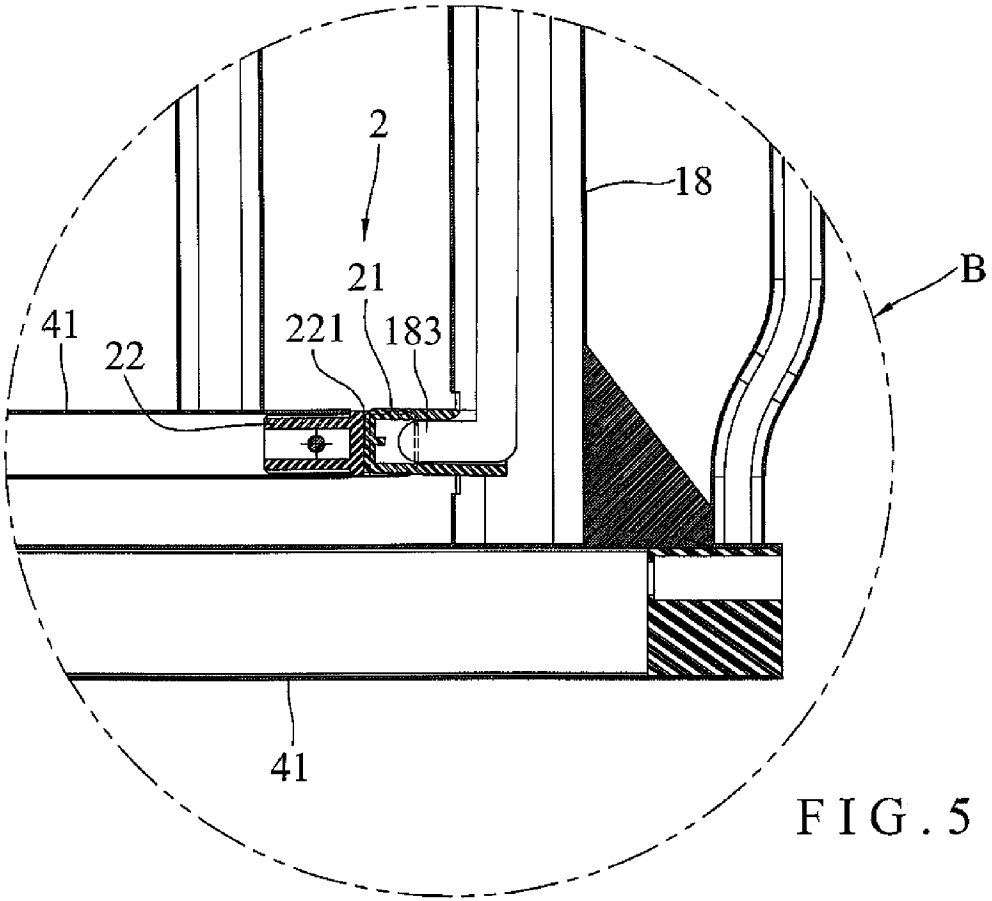
FIG. 5 is a locally enlarged cross-sectional view of the safety fence taken along circle "B" as shown in FIG. 2.
Figure 6:
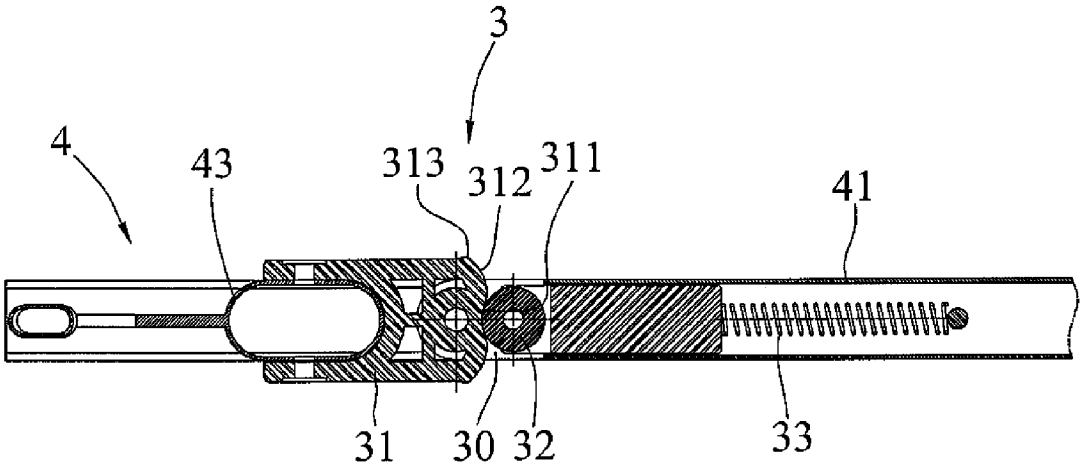
FIG. 6 is a locally enlarged cross-sectional view of the safety fence taken along section line 6-6 as shown in FIG. 2.
Figure 7:
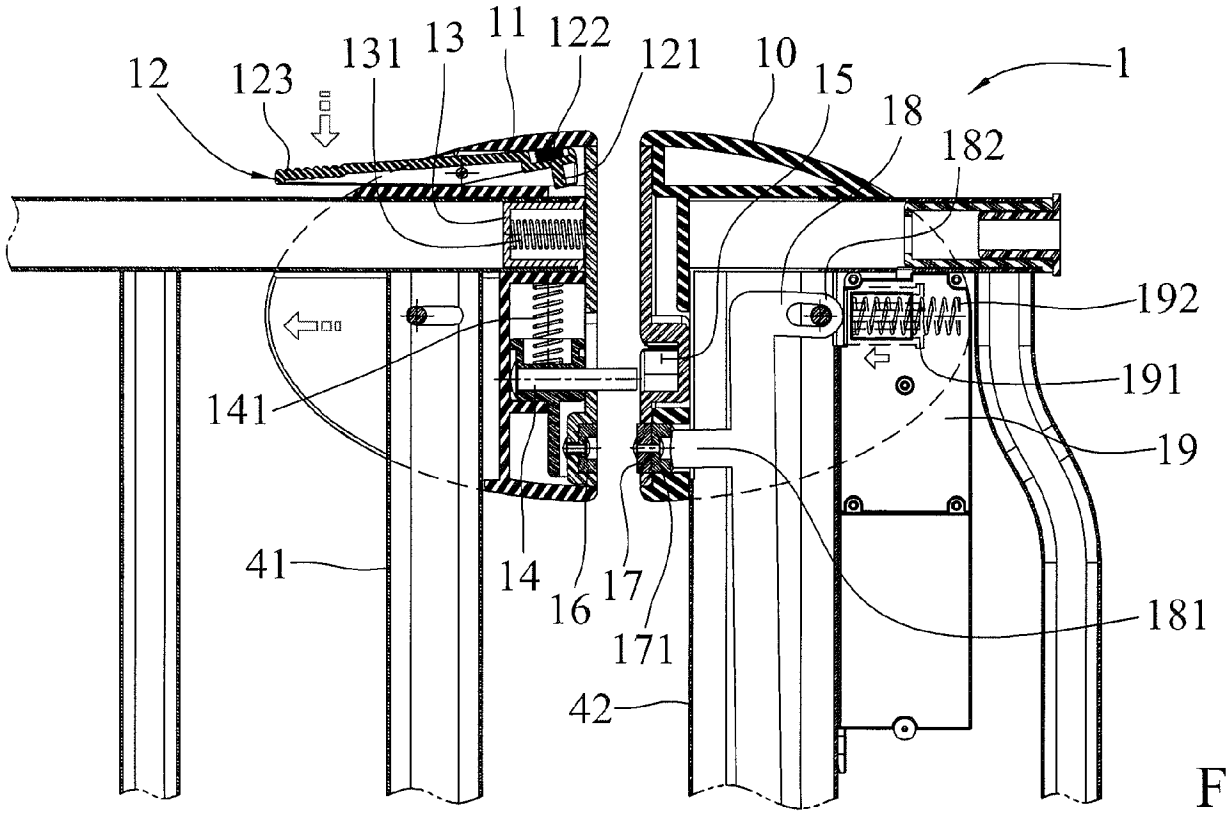
FIG. 7 is a schematic operational view of the safety fence as shown in FIG. 3.

In operation, referring to FIGS. 7-11 with reference to FIGS. 1-6, when the pressing portion 123 of the control handle 12 is pressed downward, the locking hook 121 of the control handle 12 is detached from the stop sleeve 13 to unlock the second housing 11 from the door 41 so that the second housing 11 is movable on the door 41. In such a manner, when the second housing 11 is driven by a user to move outward relative to the first housing 10 from the position as shown in FIG. 3 to the position as shown in FIG. 7, the positioning shaft 14 is detached from the positioning groove 151 of the limit track 15 so that the second housing 11 is detached from the first housing 10.

Figure 8:
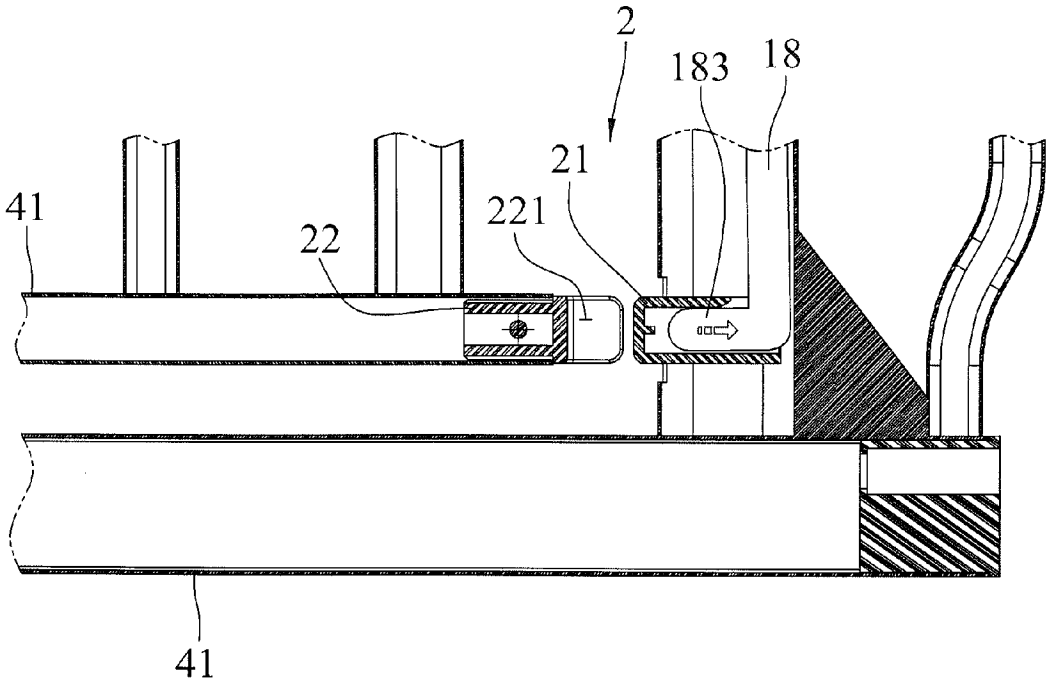
FIG. 8 is a schematic operational view of the safety fence as shown in FIG. 5.
Figure 9:
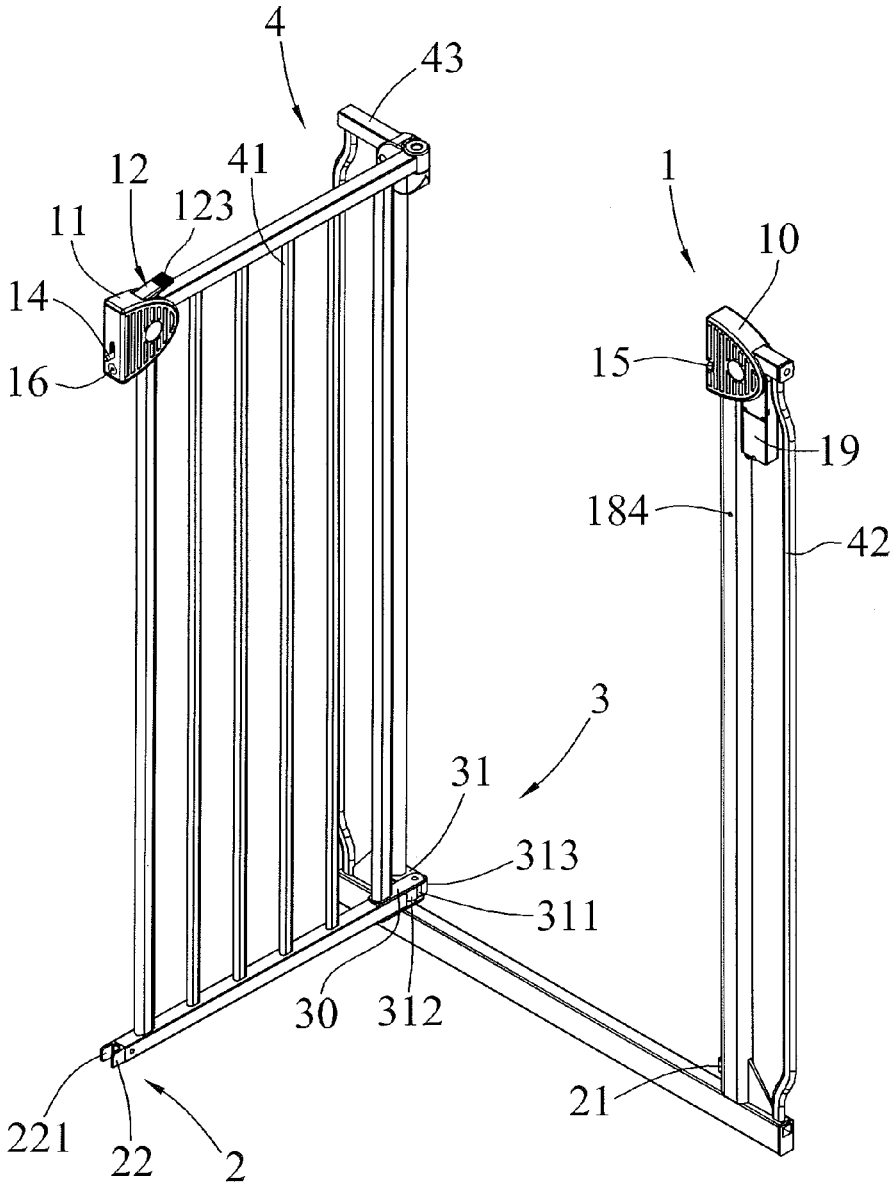
FIG. 9 is a schematic operational view of the safety fence as shown in FIG. 1.

At this time, the second magnet 16 is spaced from the first magnet 17 so that the force applied by the second magnet 16 on the first magnet 17 disappears. In such a manner, the starter 191 is pushed by the restoring force of the restoring spring 192 to move the abutting arm 182 of the link 18 so as to pivot the link 18 about the pivot shaft 184 so that the drive arm 183 of the link 18 is driven to move the locking member 21 outward relative to the retaining member 22 such that the locking member 21 is detached from the locking recess 221 of the retaining member 22 as shown in FIG. 8 to unlock the door 41 from the second rail 42. Thus, when the user exerts a force on the door 41, the door 41 can be detached from the second rail 42 and pivoted relative to the first rail 43 as shown in FIG. 9 so as to open the door unit 4.

After the door unit 4 is opened, the second housing 11 is pushed toward the first housing 10 by the restoring force of the return spring 131 and is moved to the original state, and the positioning shaft 14 is moved in concert with the second housing 11 to the original state as shown in FIG. 3. In addition, the warning member 19 is activated when the starter 191 is moved so that the warning member 19 will emit a warning signal after a preset period of time to inform the user that the door unit 4 has been opened.

Figure 10:
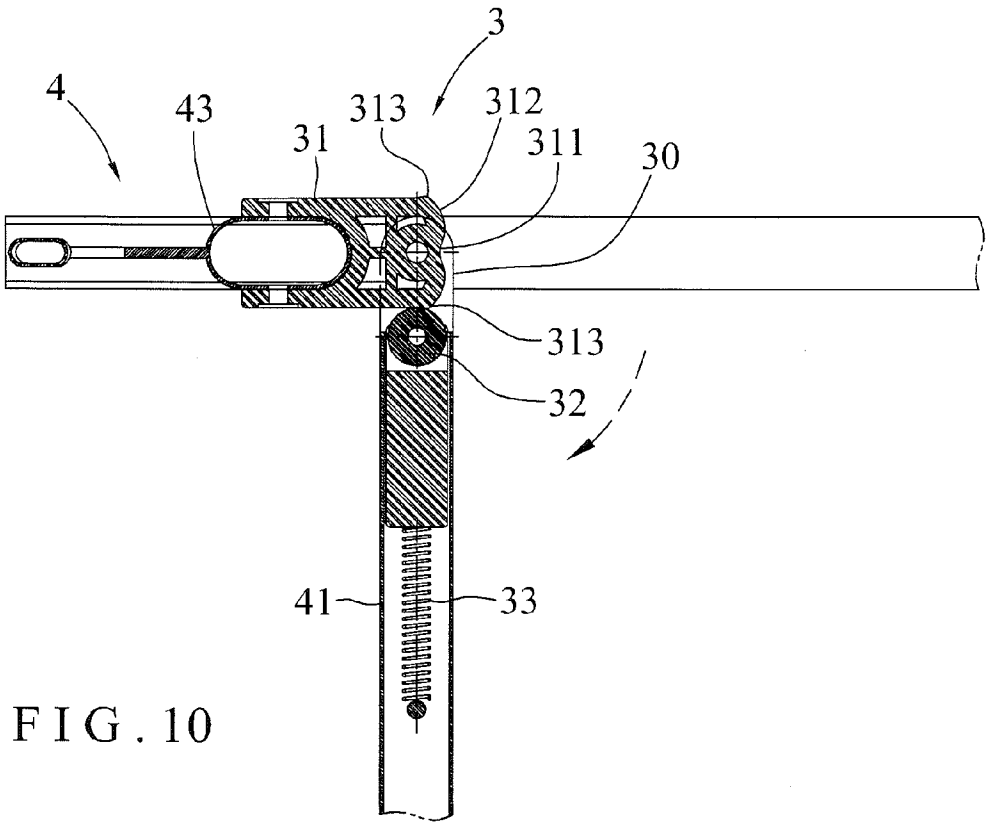
FIG. 10 is a schematic operational view of the safety fence as shown in FIG. 6.

When the door unit 4 is opened to reach a predetermined angle, for example, when the door 41 is moved relative to the first rail 43 to a position as shown in FIG. 10 where the door 41 is perpendicular to the first rail 43 (that is, the predetermined angle is about ninety degrees), the positioning wheel 32 is positioned by the respective positioning protrusion 313 so that the door 41 is positioned on the first rail 43 so as to position the door unit 4 temporarily.

Figure 11:
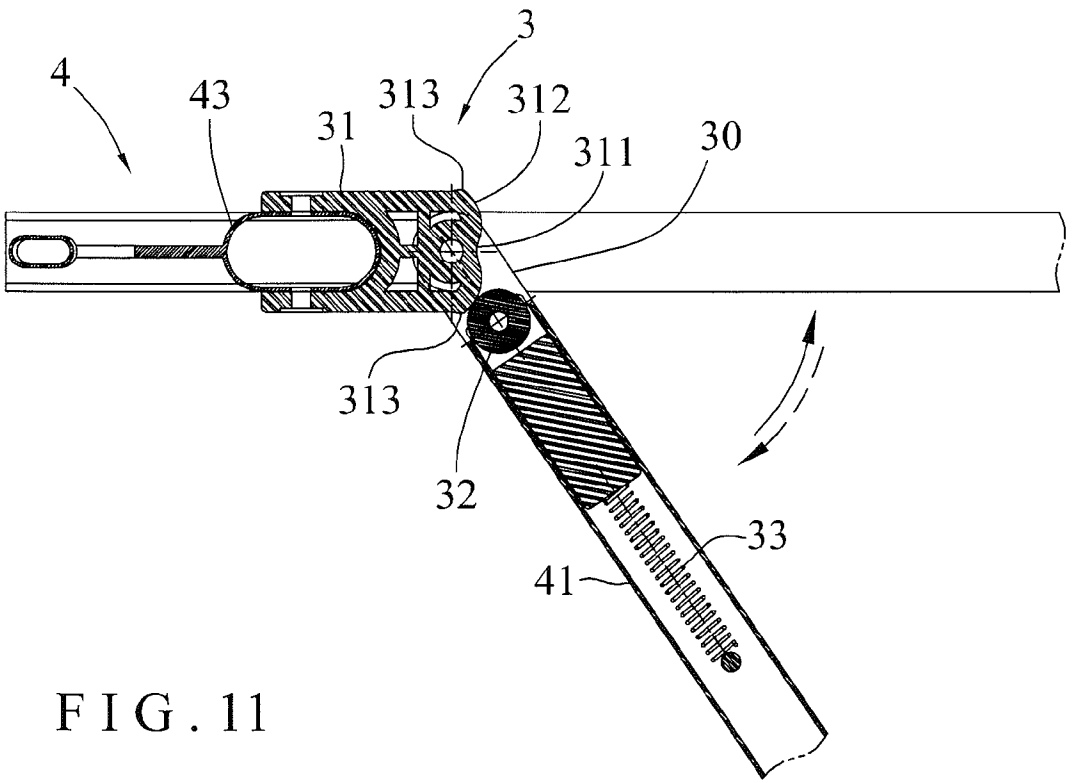
FIG. 11 is a schematic operational view of the safety fence as shown in FIG. 10.

On the contrary, when the door unit 4 is not opened to reach the predetermined angle as shown in FIG. 11, the positioning wheel 32 will be moved backward on the positioning member 31 so that the door 41 is moved backward relative to the first rail 43 from the position as shown in FIG. 11 to the position as shown in FIG. 6, and the positioning wheel 32 is positioned on the concave face 311 of the positioning member 31 again. At this time, the convex face 312 of the positioning member 31 can guide movement of the positioning wheel 32.

Figure 4:
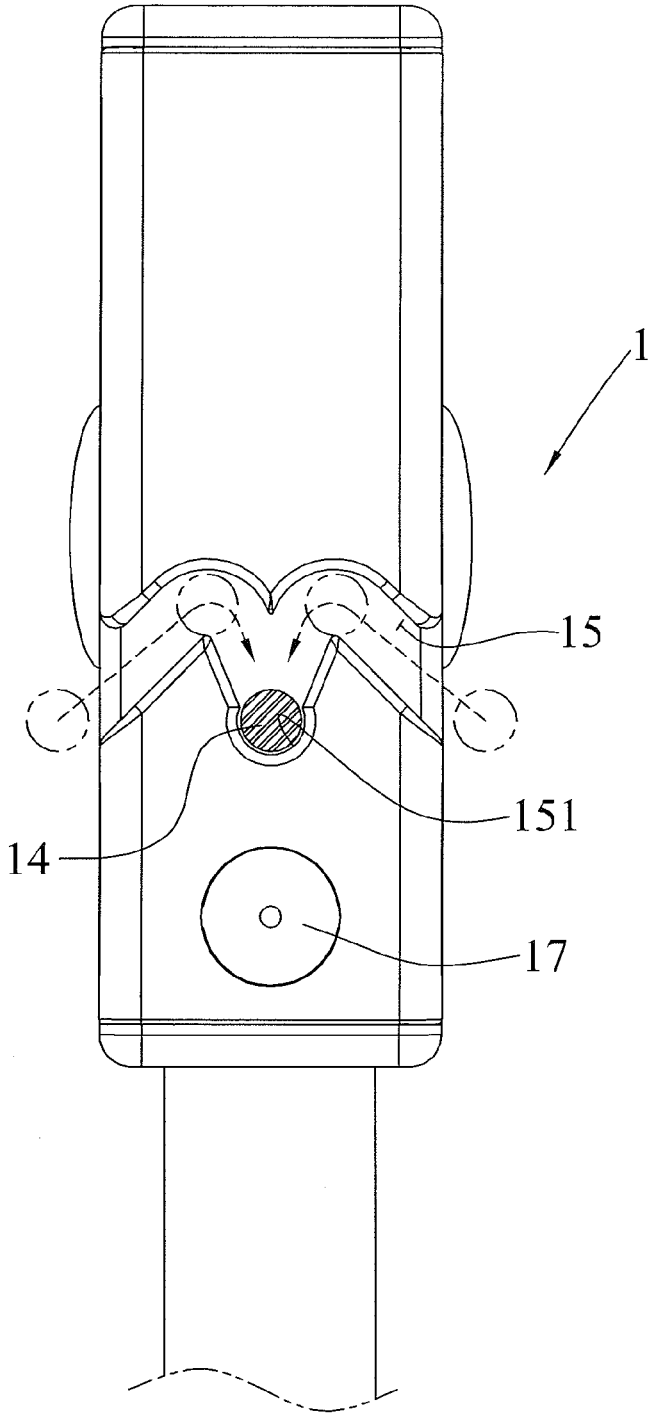
FIG. 4 is a side cross-sectional view of a switching mechanism of the safety fence as shown in FIG. 1.

In such a manner, when the second housing 11 is moved to abut the first housing 10 as shown in FIG. 1, the positioning shaft 14 is inserted through the limit track 15 into the positioning groove 151 as shown in FIG. 4 and is positioned in the positioning groove 151 of the limit track 15 so that the second housing 11 is locked onto the first housing 10. At the same time, the first magnet 17 aligns with and is repelled by the second magnet 16 as shown in FIG. 3 to push the driven arm 181 of the link 18 so as to pivot the link 18 about the pivot shaft 184 so that the drive arm 183 of the link 18 is driven to move the locking member 21 toward the retaining member 22 such that the locking member 21 is locked in the locking recess 221 of the retaining member 22 as shown in FIG. 5 to lock the door 41 onto the second rail 42 so as to close the door unit 4 again.

Accordingly, when the door unit 4 is not opened to reach the predetermined angle, the door 41 is driven by the positioning and restoring unit 3 and is returned and moved backward relative to the first rail 43 to abut the second rail 42 so that the door 41 is locked onto the second rail 42 by the locking unit 2 so as to close the door unit 4 automatically. In addition, after the door unit 4 is opened, the warning member 19 is activated to emit a warning signal after a preset period of time so as to inform the user that the door unit 4 has been opened. Further, when the door unit 4 is opened to reach the predetermined angle, the door 41 is positioned on the first rail 43 by the positioning and restoring unit 3 so as to position the door unit 4 temporarily.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A safety fence, comprising:

a door unit;

a locking unit mounted on the door unit to detachably lock the door unit;

a switching mechanism mounted on the door unit and connected with the locking unit to lock and unlock the locking unit; and a positioning and restoring unit mounted on the door unit to position the door unit when the door unit is movable from an original position to a predetermined position and to restore the door unit to the original position when the door unit is not disposed at the predetermined position;

wherein the door unit includes:

a first rail;

a second rail spaced from the first rail; and a door having a first end pivotally connected with the first rail and a second end detachably locked onto the second rail by the switching mechanism and the locking unit;

the locking unit is mounted between the second rail and the door;

the switching mechanism is mounted between the second rail and the door;

the positioning and restoring unit is mounted between the first rail and the door;

the locking unit includes:

a retaining member mounted on a lower end of the door; and a locking member movably mounted on a lower end of the second rail and detachably locked onto the retaining member;

the switching mechanism includes:

a first housing mounted on an upper end of the second rail;

a limit track mounted on the first housing;

a second housing movably mounted on an upper end of the door;

a positioning shaft mounted on the second housing to move in concert with the second housing and detachably limited in the limit track;

a link pivotally mounted on the second rail and having an upper end provided with a driven arm and a lower end provided with a drive arm connected with the locking member to move the locking member relative to the retaining member;

a first magnet movably mounted on the first housing and connected with the driven arm of the link to move the driven arm of the link;

a second magnet secured on the second housing and repelling the first magnet to move the first magnet;

a stop sleeve fixed on the upper end of the door and disposed in the second housing;

a return spring biased between the stop sleeve and the second housing to push the second housing toward the first housing;

a control handle pivotally mounted on the second housing and having a first end provided with a locking hook detachably locked onto the stop sleeve and a second end provided with a pressing portion; and a press spring mounted on the second housing and biased between the locking hook of the control handle and the second housing to push the locking hook of the control handle toward the stop sleeve.

2. The safety fence of claim 1, wherein the retaining member has a side formed with a locking recess; and the locking member is releasably locked in the locking recess of the retaining member.

3. The safety fence of claim 1, wherein the switching mechanism further includes:

a guide block movably mounted on the first housing and connected with the first magnet to guide movement of the first magnet relative to the first housing;

the guide block is located between the first magnet and the driven arm of the link.

4. The safety fence of claim 1, wherein the limit track has a middle portion formed with a positioning groove;

the positioning shaft is detachably positioned in the positioning groove of the limit track;

the positioning shaft is detachable from the positioning groove of the limit track when the second housing is movable outward relative to the first housing.

5. The safety fence of claim 1, wherein the positioning shaft is movable upward and downward in the second housing; and the switching mechanism further includes:

a push spring mounted in the second housing and biased between the second housing and the positioning shaft to push the positioning shaft downward in the second housing.

6. The safety fence of claim 1, wherein the upper end of the link is further provided with an abutting arm;

the switching mechanism further includes:

a warning member mounted on the upper end of the second rail;

a starter movably mounted on the warning member and abutting the abutting arm of the link; and a restoring spring mounted in the warning member and biased between the warning member and the starter to push the starter toward the abutting arm of the link.

7. The safety fence of claim 1, wherein the positioning and restoring unit includes:

a positioning member mounted on a lower end of the first rail;

a pivot member mounted on the lower end of the door and pivotally connected with the positioning member;

a positioning wheel rotatably mounted on the pivot member and movable to press the positioning member and to position the pivot member on the positioning member; and a restoring member mounted in the lower end of the door and biased between the door and the positioning wheel to push the positioning wheel toward the positioning member.

8. The safety fence of claim 7, wherein the positioning member has a first end secured on the lower end of the first rail and a second end having a middle portion formed with a concave face to receive the positioning wheel.

9. The safety fence of claim 8, wherein the concave face of the positioning member has two opposite sides each formed with a convex face to guide the positioning wheel.

10. The safety fence of claim 9, wherein the second end of the positioning member has two opposite corners each formed with a positioning protrusion adjoining the respective convex face to position the positioning wheel.

11. The safety fence of claim 4, wherein the limit track has a substantially inverted W-shaped profile.

12. The safety fence of claim 1, wherein the link has a mediate portion pivotally connected with the second rail by a pivot shaft.

13. The safety fence of claim 1, wherein the locking hook of the control handle is movably mounted in the second housing;

the pressing portion of the control handle protrudes outward from the second housing;

the press spring is disposed above the locking hook of the control handle;

the locking hook of the control handle is detachably locked the upper end of the door;

the return spring is received in the stop sleeve.

14. The safety fence of claim 5, wherein the push spring is disposed above the positioning shaft.

* * * * *